US007728694B2

(12) United States Patent
Jensen et al.

(10) Patent No.: US 7,728,694 B2
(45) Date of Patent: Jun. 1, 2010

(54) SURFACE MOUNT STRIPLINE DEVICES HAVING CERAMIC AND SOFT BOARD HYBRID MATERIALS

(75) Inventors: Bo Jensen, Minoa, NY (US); Michael J. Lugert, Manlius, NY (US); Adam J. Gadway, Central Square, NY (US)

(73) Assignee: Anaren, Inc., East Syracuse, NY (US)

( * ) Notice: Subject to any disclaimer, the term of this patent is extended or adjusted under 35 U.S.C. 154(b) by 54 days.

(21) Appl. No.: 11/829,420

(22) Filed: Jul. 27, 2007

(65) Prior Publication Data

US 2009/0027143 A1 Jan. 29, 2009

(51) Int. Cl.
*H01P 5/18* (2006.01)
*H01P 3/08* (2006.01)

(52) U.S. Cl. ..... 333/116; 333/26; 333/136; 333/246

(58) Field of Classification Search ..... 333/116, 333/246, 26, 128, 136
See application file for complete search history.

(56) References Cited

U.S. PATENT DOCUMENTS 3,581,243 A * 5/1971 Alford ..... 333/116
4,821,007 A 4/1989 Fields et al.
5,032,803 A * 7/1991 Koch ..... 333/116
5,175,522 A 12/1992 Clark et al.
5,369,379 A * 11/1994 Fujiki ..... 333/116

(Continued)

OTHER PUBLICATIONS

Kim, Ki Hyun; Patent Cooperation Treaty PCT International Search Report; Korean Intellectual Property Office; Nov. 19, 2008; 3 pp.

(Continued)

*Primary Examiner*—Benny Lee
(74) *Attorney, Agent, or Firm*—Daniel P. Malley; Bond, Schoeneck & King, PLLC

(57) ABSTRACT

The present invention is directed to a method for making a hybrid material stripline device. The method includes providing an inner layer of material, the inner layer including a dielectric material and at least one conductive sheet. At least one stripline device is formed in the inner layer by processing the at least one conductive sheet. The at least one stripline device is characterized by a surface area footprint. A first exterior layer and a second exterior layer are provided. At least one of the first exterior layer and/or the second exterior layer includes at least one ceramic portion. The at least one ceramic portion has a ceramic surface area greater than or substantially equal to the surface area footprint of the at least one stripline device. At least one of the first exterior layer and/or the second exterior layer further includes a softboard dielectric material. The inner layer of material is sandwiched between the first exterior layer and the second exterior layer. The first exterior layer, the inner layer and the second exterior layer are laminated to form a laminate panel structure, a surface of the first exterior layer forming a first major surface of the laminate panel structure and a surface of the second exterior layer forming a second major surface of the laminate panel structure. A first conductive sheet is disposed over the first major surface and a second conductive sheet is disposed over the second major surface, the first conductive sheet and the second conductive sheet being configured as parallel ground planes for the at least one stripline device.

25 Claims, 8 Drawing Sheets

U.S. PATENT DOCUMENTS

| | | | | |
|---|---|---|---|---|
| 6,140,886 | A | 10/2000 | Fratti et al. | |
| 6,208,220 | B1 * | 3/2001 | Logothetis | 333/116 |
| 6,639,486 | B2 | 10/2003 | Buck | |
| 6,822,532 | B2 | 11/2004 | Kane et al. | |
| 6,900,708 | B2 | 5/2005 | White et al. | |

OTHER PUBLICATIONS

Kim, Ki Hyun; Patent Cooperation Treaty PCT Written Opinion of the International Seaching Authority; Korean Intellectual Property Office; Nov. 19, 2008; 3 pp.

* cited by examiner

SURFACE MOUNT STRIPLINE DEVICES HAVING CERAMIC AND SOFT BOARD HYBRID MATERIALS

BACKGROUND OF THE INVENTION

1. Field of the Invention

The present invention relates generally to radio frequency (RF) devices, and particularly to stripline transmission device packages.

2. Technical Background

Stripline devices are used in RF and microwave circuit applications. A stripline transmission line is implemented by sandwiching a planar conductor between a pair of ground planes. A dielectric material is interposed between the planar conductor and each of the ground planes. Of course, transmission lines are used to interconnect circuit elements and implement impedance transformation networks. Stripline structures may also be used to realize directional couplers, baluns, power dividers and other such devices commonly used in RF and microwave circuits.

A coupler is a four-port device that includes a primary transmission line disposed in close proximity with a secondary transmission line. Power is directed into the device by way of an input port connected to the primary transmission line. The power propagates along the primary transmission line and the electromagnetic waves are coupled onto the secondary line. The coupler structure, therefore, would be implemented in a stripline configuration by disposing the primary conductor and the secondary conductor on opposite sides of a very thin dielectric material. The coupled structure is subsequently disposed between the two ground planes in the manner previously described. Of course, baluns, power combiners, power splitters and the like may be implemented using coupler structures. Those of ordinary skill in the art will understand that a coupler is synonymous with the term "power combiner" because it couples or combines two input signals and provides a single combined output. One the other hand, those of ordinary skill in the art will also understand that if the coupler is used such that a single signal is directed into an input, the coupler will split the signal into two output signals. Those of ordinary skill in the art will understand that the coupler is employed, therefore, as a power splitter. A coupler may also be a hybrid coupler, i.e., the two signals that are output are 90° out of phase with respect to one another. Those of ordinary skill in the art will understand that two couplers may be used in tandem to form a balun structure, See, for example, FIG. 9 which shows a balun constructed using a first and a second backward wave symmetrical couplers.

The stripline devices discussed above may be implemented in surface mounted packages. Surface mounted devices are advantageous because they are dimensionally small (i.e., less than 1.0 inch) and typically have a low profile (less than 0.15 inches). Of course, the dimensions will vary as a function of power and frequency. Accordingly, these devices are ideally suited for relatively small printed circuit boards used in wireless infrastructure applications, such as power chips, etc.

In one approach, the manufacturing process produces a rectangular panel having a two-dimensional array of devices disposed thereon. The panel is implemented by sandwiching several layers of softboard dielectric materials. The stripline structure itself is formed using a very thin softboard layer (less than 10 mils) that includes copper foil disposed on either side. The array of stripline structures are typically formed by using standard photolithography techniques, i.e., the array of stripline devices are imaged onto the copper surfaces and subsequently etched, removing any excess copper material. This process is quite accurate and allows the placement of coupled transmission lines on either side of the thin panel within very high tolerances. A relatively thicker softboard dielectric panel (e.g., ~less than 60 mils) is disposed on either side of the stripline structure. The thicker panels have a dielectric surface positioned next to the stripline structure and an exterior copper foil surface that functions as the ground plane. The softboard sandwich is laminated by applying heat and pressure. The laminated panel is easily cut and divided into its constituent individual components.

One of the benefits of the approach briefly described above is its extreme accuracy. The process is well understood and produces very smooth and well defined lines. Device performance parameters such as amplitude balance, phase balance, insertion loss, etc. are quite predictable. The process is very efficient, very large panels may be produced using very high levels of automation. Thus, the method is very conducive to low cost, high volume manufacturing. However, one drawback associated with this technique relates to the poor thermal conductivity of softboard materials. As those of ordinary skill in the art will appreciate, thermal conductivity is proportional to the amount of power that the individual component is able to dissipate.

What is needed, therefore, is a method for making stripline devices that is characterized by all of the above advantages associated with softboard devices, while at the same time, being characterized by high thermal characteristics and high power handling capabilities.

SUMMARY OF THE INVENTION

The present invention addresses the needs described above by providing a method for making stripline devices that is characterized by all of the advantages associated with softboard devices, while at the same time, being characterized by high thermal characteristics and high power handling capabilities.

One aspect of the present invention is directed to a method for making a hybrid material stripline device. The method includes providing an inner layer of material, the inner layer including a dielectric material and at least one conductive sheet. At least one stripline device is formed in the inner layer by processing the at least one conductive sheet. The at least one stripline device is characterized by a surface area footprint. A first outer layer and a second outer layer are provided. At least one of the first outer layer and/or the second outer layer includes at least one ceramic portion. The at least one ceramic portion has a ceramic surface area greater than or substantially equal to the surface area footprint of the at least one stripline device. At least one of the first outer layer and/or the second outer layer further includes a softboard dielectric material. The inner layer of material is sandwiched between the first outer layer and the second outer layer. The first outer layer, the inner layer and the second outer layer are laminated to form a laminate panel structure, a surface of the first outer layer forming a first major surface of the laminate panel structure and a surface of the second outer layer forming a second major surface of the laminate panel structure. A first conductive sheet is disposed over the first major surface and a second conductive sheet is disposed over the second major surface, the first conductive sheet and the second conductive sheet being configured as parallel ground planes for the at least one stripline device.

In another aspect, the present invention is directed to a stripline structure that includes a first outer layer and a second outer layer disposed in substantially parallel planes one to the other. At least one of the first outer layer and/or the second outer layer includes at least one ceramic portion having a ceramic surface area. At least one of the first outer layer and/or the second outer layer comprises a softboard dielectric material. An inner layer is sandwiched between the first outer layer and the second outer layer, the inner layer having at least one stripline device formed therein. The at least one stripline device is characterized by a surface area footprint. The ceramic surface area is greater than or substantially equal to the surface area footprint. The first outer layer, the inner layer, and the second outer layer are laminated to form a panel, the panel having a first outer major surface and a second outer major surface. A first conductive sheet is disposed over the first outer major surface and a second conductive sheet is disposed over the second outer major surface. The first conductive sheet and the second conductive sheet are configured as parallel ground planes for the at least one stripline device. A plurality of conductive vias are formed in the first outer layer and/or the second outer layer. The plurality of conductive vias are in electrical communication with the at least one stripline device.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF THE INVENTION

Figure 1:
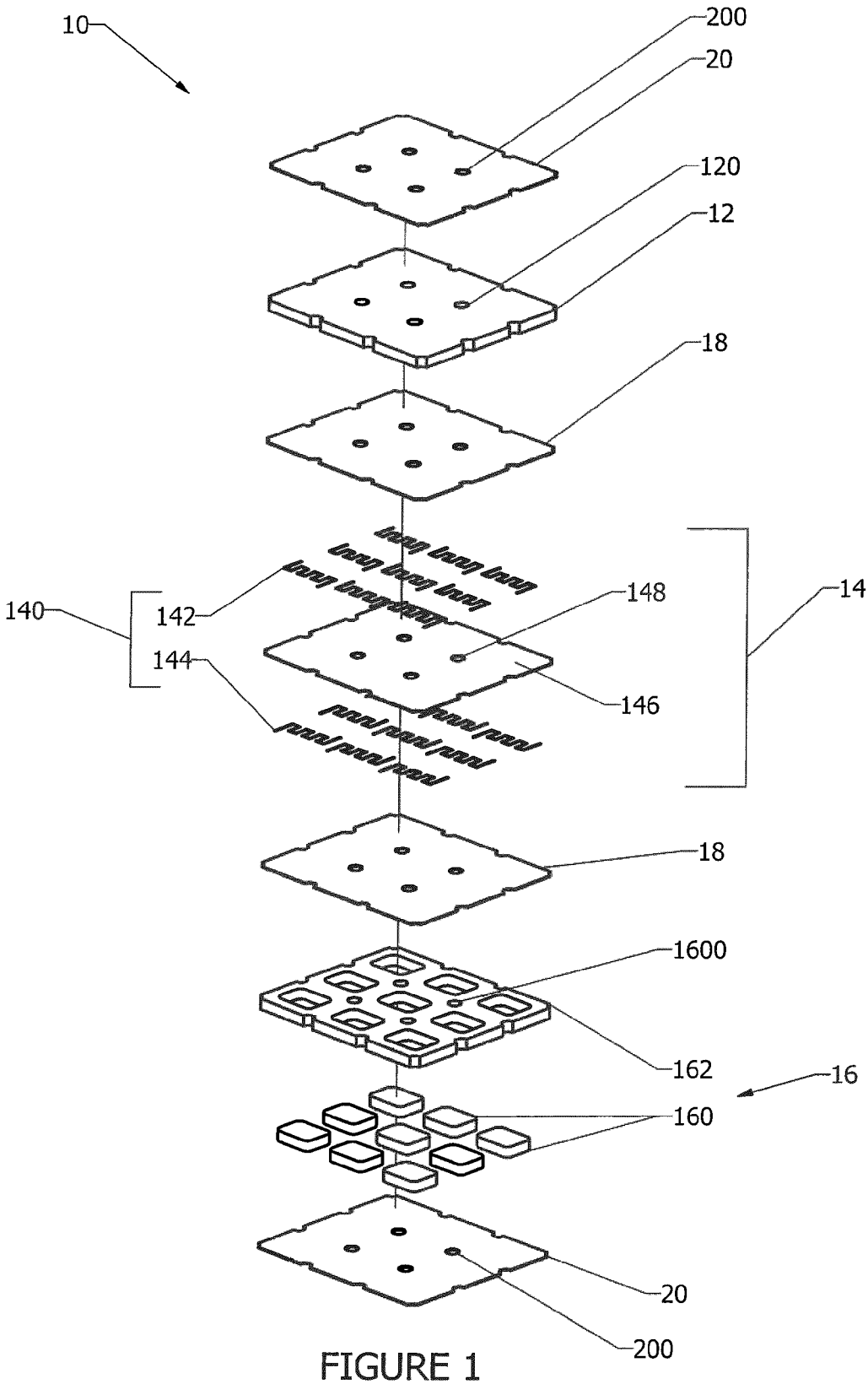
FIG. 1 is an exploded view of a first embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the stripline component of the present invention is shown in FIG. 1, and is designated generally throughout by reference numeral 10.

As embodied herein and depicted in FIG. 1, an exploded view of a first embodiment of the present invention is disclosed. The device panel structure 10 shown in FIG. 1 includes an upper dielectric layer 12 and a lower dielectric layer 16 disposed in substantially parallel planes one to the other. An inner device layer 14 is sandwiched between the upper layer 12 and the lower layer 16. Bonding film 18 is used bond the layers 12, 14, 16 together. Subsequently, heat and pressure is applied to the structure 10 to form laminated panel.

The inner circuit layer 14 is formed from a relatively thin softboard dielectric material 146 that includes a top conductive layer and a bottom conductive layer disposed on either side of dielectric 146. Each stripline device 140 is formed using standard photolithographic techniques. As shown, the stripline transmission line structures (142, 144) that form each device 140 are imaged onto the top and bottom layers disposed on dielectric layer 146 and excess material is etched away. The transmission lines (142, 144) formed on the top and bottom surfaces may be disposed aligned thereon with great accuracy. Layer 14 includes an N×M array of stripline devices 140 formed thereon. In the example shown in FIG. 1, both N and M are only equal to three (3) for clarity of illustration. Those of ordinary skill in the art will understand that N and M are typically very large integer values. For example, major surface area of the device panel structure 10 is typically greater than one (1) square foot. The stripline devices 140 themselves are typically much smaller, usually less then 1.0 square inch. The surface area footprint of a typical device is usually, half that, i.e., 0.05 inches. Of course, the surface footprint of the device may be any suitable size depending on any number of factors such as package form factor, device type, etc.

In the example embodiment provided in FIG. 1, the top dielectric layer 12 is formed from a softboard dielectric material. A conductive sheet 20 is disposed thereon and functions as a top ground plane. The bottom dielectric layer 16 is also formed from a softboard dielectric material 162. During a machining potion of fabrication, an N×M array of cavities are removed from the dielectric material 162 and ceramic "pucks" 160 are inserted. In this embodiment, the surface area of each ceramic puck is substantially equal to the surface area footprint of each device 140. The ceramic pucks 160 are is typically disposed on the bottom of the device component to provide high thermal conductivity to the heat sink formed in the printed circuit board (PCB). However, the present invention may also be practiced by disposing the ceramic pucks in either the top layer 12, bottom layer 16, or both. Those of ordinary skill in the art will understand that the ceramic pucks may be sized to cover multiple components 140, i.e., (N×M)/K sub-arrays of ceramic pucks may be employed.

Of course, conductive vias (200, 120, 148, 1600) are formed in the various layers of the device. As those of ordinary skill in the art will appreciate, the conductive vias are in electrical communication with the various ports of each stripline device 140. The ports are subsequently connected to pads disposed on the exterior of the component package.

The metal/dielectric laminates used to fabricate upper layer 12 (20), inner layer 14, and lower layer 162 (20) are often called "soft-board." The laminate materials may be selected to optimize physical properties such as mechanical stability, electrical performance, planarity and rigidity. Softboard laminate materials may be employed to produce extremely accurate circuit traces having very small line widths. For example, the softboard dielectric may be formed using materials such as FR-4, Rogers RO 3003, Pyralux, etc. FR-4, of course, is produced by applying high pressure to a woven glass woven fabric impregnated with an epoxy resin binder. FR-4 is commonly used dielectric material because it is characterized by excellent mechanical properties, electric properties, and is dimensionally stable (i.e., very low shrinkage). Pyralux is a composite material and RO 3003 is a ceramic-filled PTFE composite material. Both materials used for circuit boards in microwave applications.

The ceramic pucks may be formed using any suitable ceramic material such as LTCC, alumina, AIN, and BeO ceramics. Low temperature co-fired ceramics (LTCC) are formed from "green tape." A green tape is produced using selected glass compositions and/or ceramic powders. The powder is mixed with a binder and a solvent. The mixture is subsequently cast and cut to form the green tapes. In accordance with the present invention, interconnecting vias may be formed in the green tape before firing. As those of ordinary skill in the art will understand, the composition of the glass and ceramic powders, of course, determines the coefficient of thermal expansion, the dielectric constant and the compatibility of the ceramic material to the other various materials employed herein.

Figure 2:
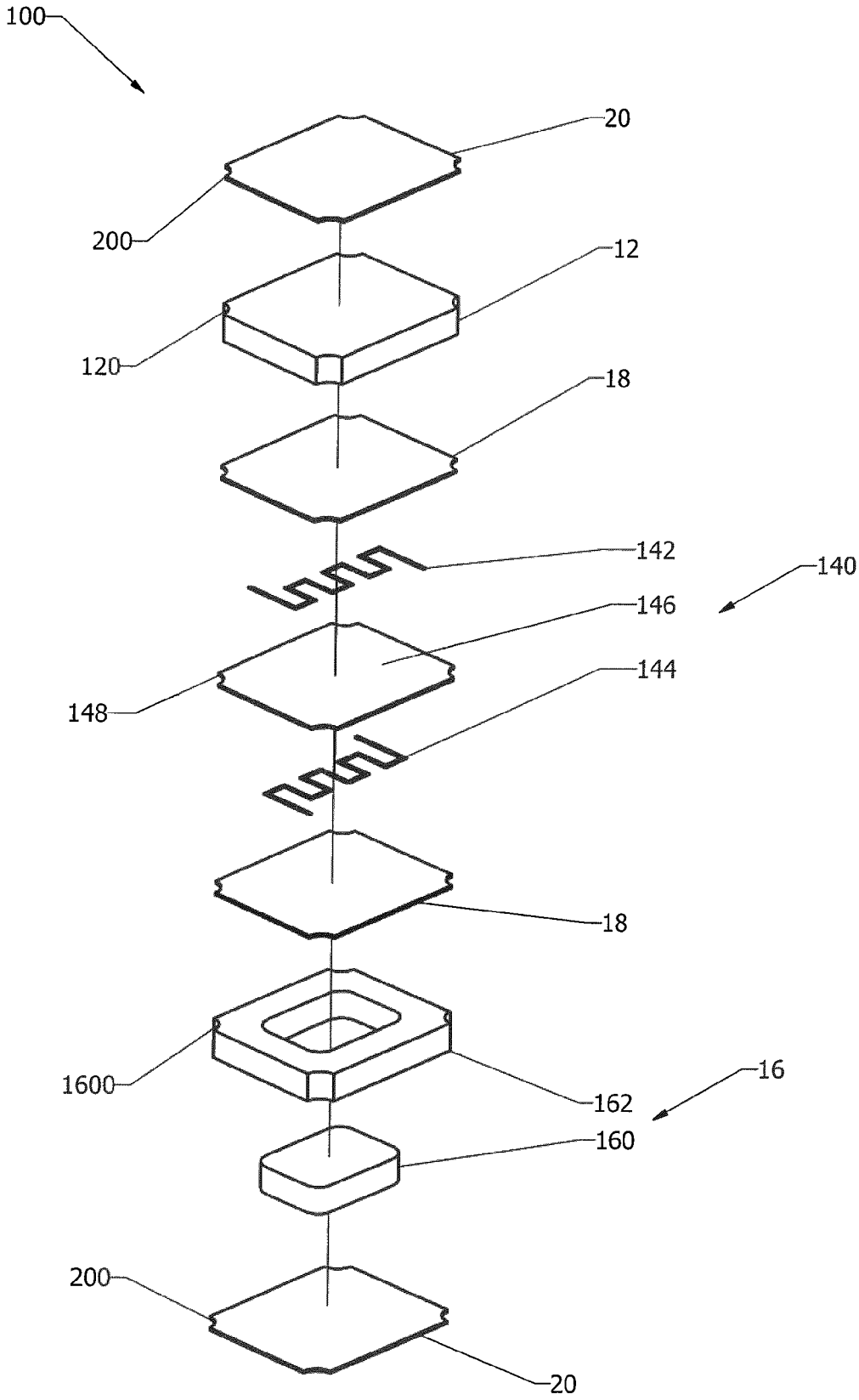
FIG. 2 is a detail view showing a coupler configuration in accordance with an embodiment of the present invention.

As embodied herein and depicted in FIG. 2, a detail view showing a four port directional coupler component 100 fabricated in the manner discussed above. Coupler component 100 includes two planar transmission lines 142 and 144 disposed between two ground planes 20. The transmission lines 142 and 144 are formed on the upper and lower surfaces, respectively, of the inner dielectric layer 146. Disposed between transmission line conductors 142, 144 and ground planes 20 are the upper dielectric layer 12 and lower ceramic puck 160, respectively. The present invention may be configured to implement hybrid couplers, baluns, power dividers, power combiners and other such stripline components.

Figure 9:
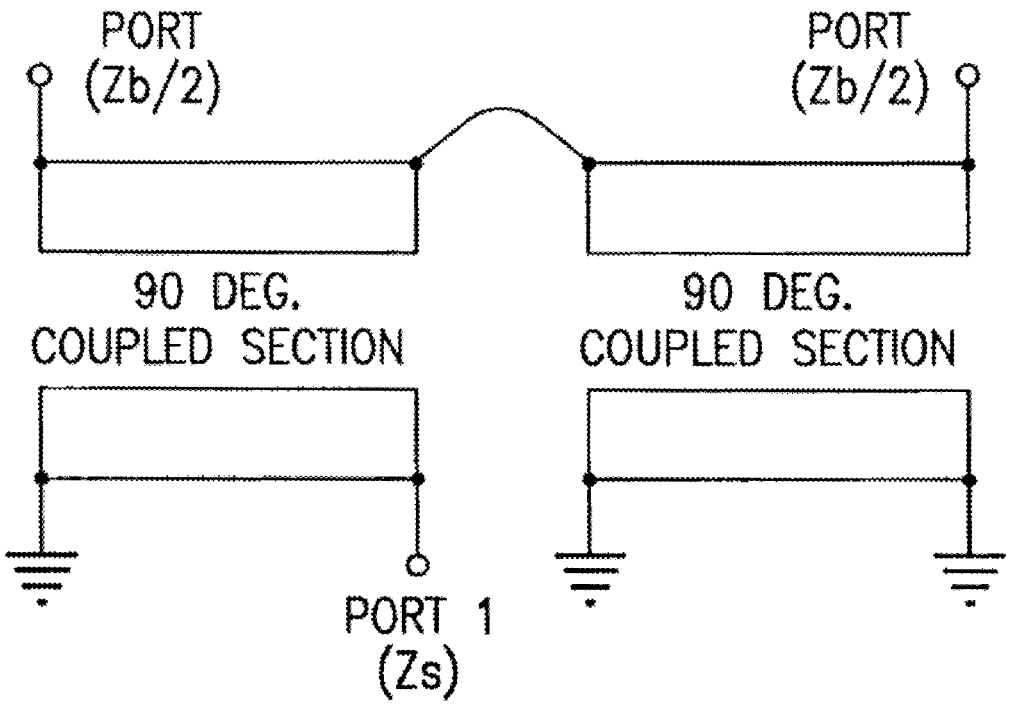
Figure 9 (Related Art)
FIG. 9 is an example of a related art balun structure that may be fabricated in accordance with the present invention.

As noted above, those of ordinary skill in the art will understand that a coupler is synonymous with the term "power combiner" because it couples or combines two input signals and provides a single combined output. On the other hand, those of ordinary skill in the art will also understand that if the coupler is used such that a single signal is directed into an input, the coupler will split the signal into two output signals. Those of ordinary skill in the art will understand that the coupler is employed, therefore, as a power splitter. A coupler may also be a hybrid coupler, i.e., the two signals that are output are 90° out of phase with respect to one another. Those of ordinary skill in the art will understand that two couplers may be used in tandem to form a balun structure. See, for example, FIG. 9 which shows a balun constructed using a first and a second backward wave symmetrical couplers.

The physical dimensions of the coupling elements are typically computed using suitable computational tools. Of course, coupling requirements dictate line widths, line spacing and ground plane spacing. In a hybrid coupler, three (3) dB coupling between the conductors with a transmission line impedance of 50 ohms is often desirable. The width of the conductors required to obtain this impedance for a given dielectric (e.g., FR-4) may be readily computed. The length of the conductors is selected to be a quarter wavelength at the frequency of interest.

As shown in the "one-device" detail view of FIG. 2, the interconnection vias (200, 120, 148, 1600) are positioned at the corners of each device 100. In one embodiment, the interconnection vias are formed only in the softboard material. Of course, vias may also be formed in the ceramic materials depending on the design.

Figure 3:
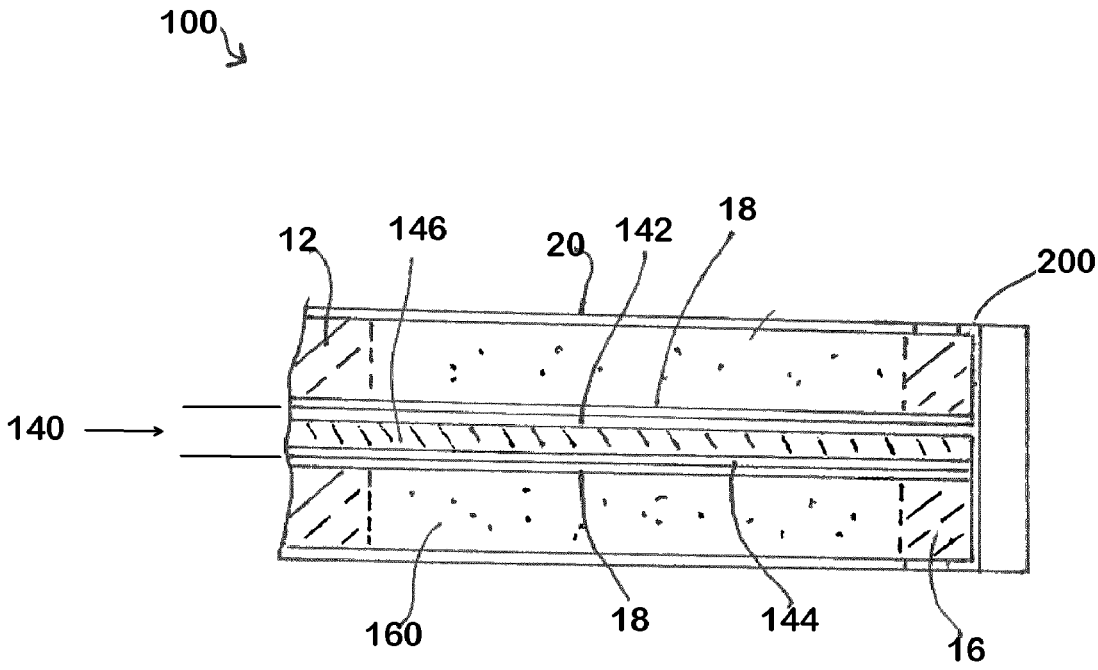
FIG. 3 is a cross-sectional view of the device in accordance with yet another embodiment of the present invention.

Referring to FIG. 3, a cross-sectional view of the device component 100 is disclosed. In the illustrated embodiment, dielectric layers 12, 16, and 146 are using any suitable type of circuit board material, e.g., FR-4, PYRALUX®, ROGERS RO 3003®, etc. The inner dielectric layer 146 is typically less than 10 mils, and very often less than 5 mils. Layer 140 includes transmission lines 142 and 144 disposed on either side, as before. The transmission lines 142 and 144 are comprised of conductive outer layers disposed over the inner dielectric, and noted previously, formed using photolithographic techniques. The conductive material may be of any suitable type, e.g., metallic, silver, copper, composite, etc.

The outer dielectric layers 12 and 16 are typically less than 60 mils thick. Each bonding layer 18 is several mils thick and may be implemented using any suitable epoxy, such as Rogers Bond ply, (e.g., thermoplastic chloro-fluorocoploymer) DuPont PFA® (e.g., perfluoroalkoxy copolymer), DuPont FEP® (e.g., fluorinated ethylene propylene), etc. As noted above, the metallic layers (20) disposed on the outer dielectric boards (12, 16) serves as ground planes.

Figure 4:
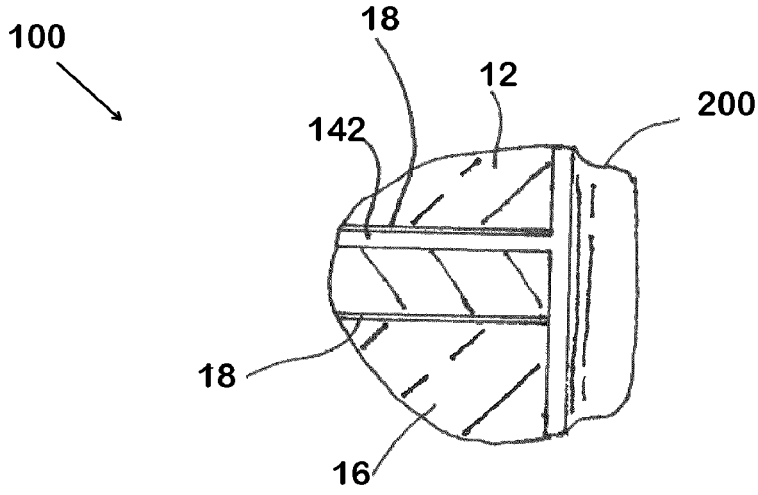
FIG. 4 is a detail view of an interconnection via shown in FIG. 3.

FIG. 4 is a detail view of an interconnection via shown in FIG. 3. Transmission line 142 is shown to terminate at substantially cylindrical plated through hole 200 disposed along the edge of component 100. Line 144 (FIG. 3)terminates in a similar fashion (not shown in FIG. 4).

Figure 5:
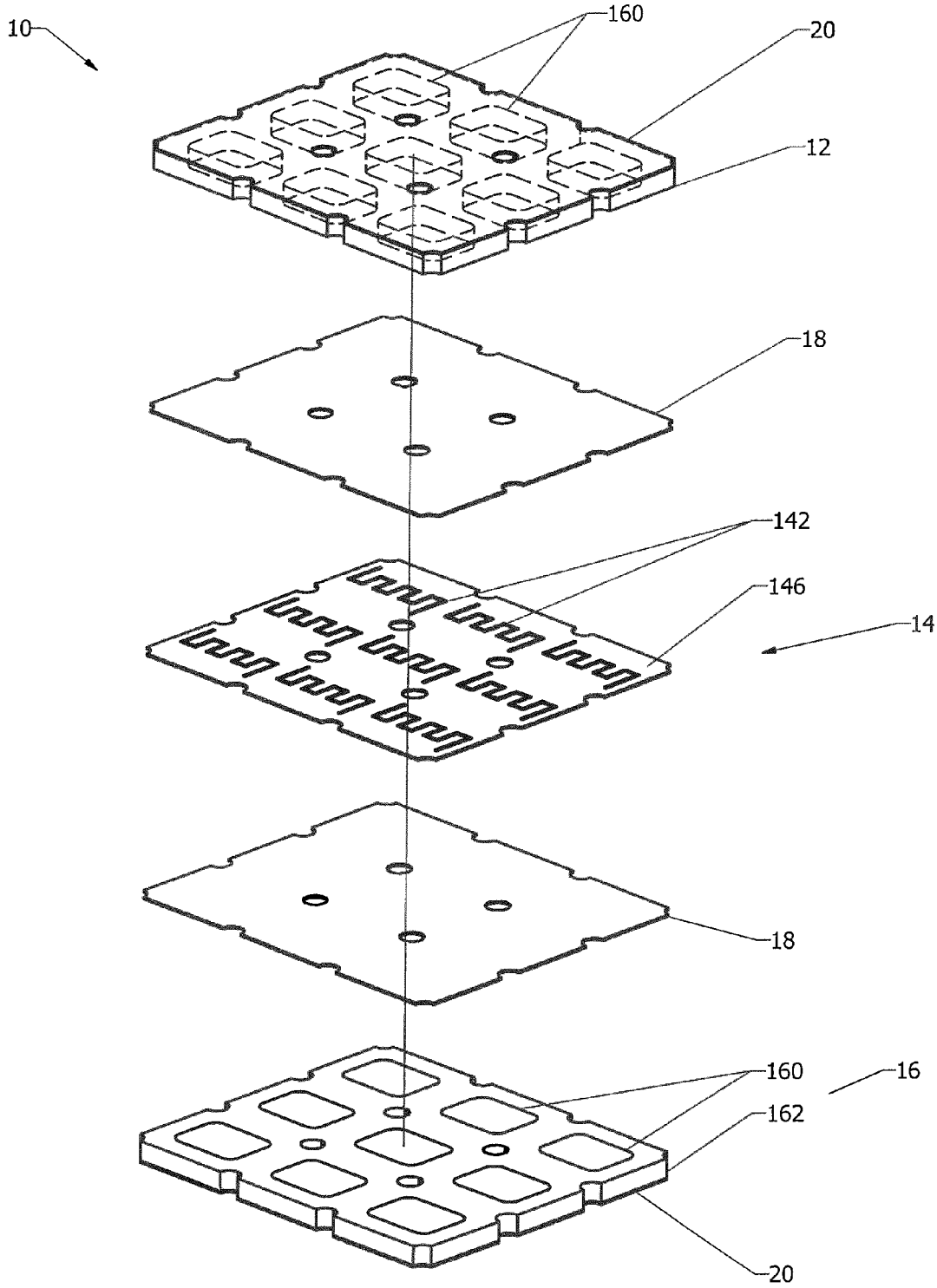
FIG. 5 is an exploded view of an alternate embodiment of the present invention.

As embodied herein and depicted in FIG. 5, an exploded view of an alternate embodiment of the present invention is disclosed. In this embodiment, the ceramic pucks are disposed on either side of the panel 10.

Figure 6A:
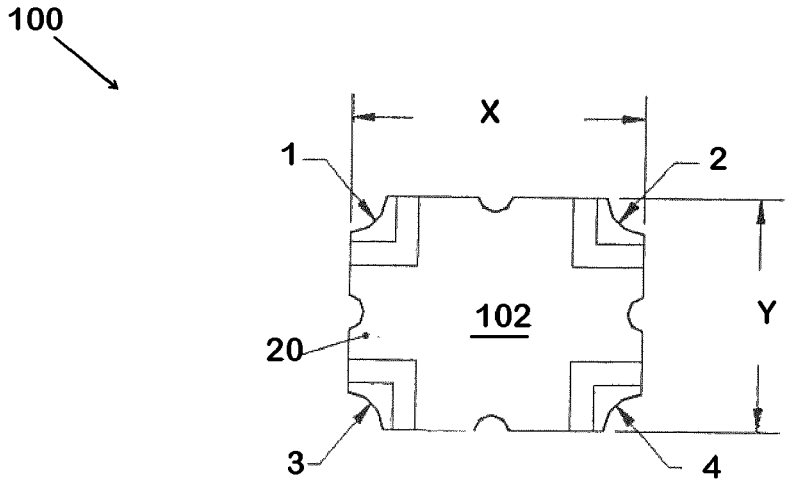
FIG. 6A-6C are various views of surface mount components in accordance with the present invention.
Figure 6B:
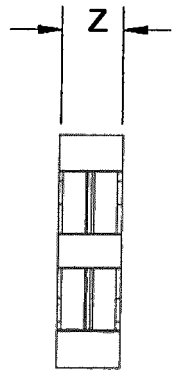
Figure 6C:
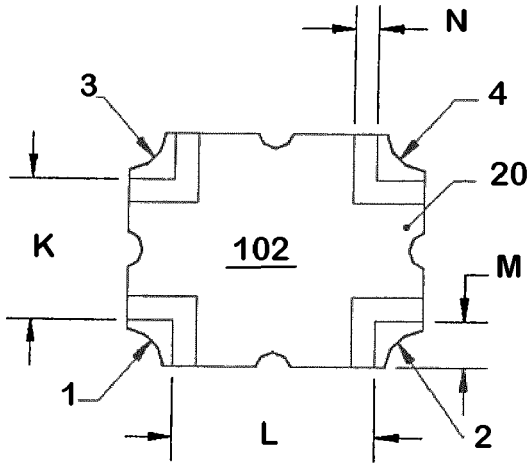

As embodied herein and depicted in FIGS. 6A-6C, various views of a surface mount component 100 in accordance with the present invention are disclosed. Component 100, fabricated in accordance with the teachings of the present invention, is a low profile, miniature 3 dB coupler disposed in a surface mount package 102 (FIGS. 6A & 6C). FIG. 6A is a top-view of component 100 and is characterized by symmetrical pin orientations. For example, any of pins 1-4 may be employed as the input port, as shown in FIGS. 6A & 6C. The symmetrical nature of component 100 automatically defines the output port, the coupled output, and the isolated port. For example, if pin 1 is selected as the input, pin 2 is defined as the isolated port, and pin 3 and pin 4 become the coupled output and the direct output, respectively.

As shown in FIG. 6A and FIG. 6C, the major surface area 20, for both the top and bottom of component 100, is a conductive material and configured to be grounded; the ground layer 20 is soldered to the PCB ground plane. Each of the pins (1-4) are configured to be connected to 50 Ohm transmission lines disposed on the PCB.

In one example embodiment depicted in FIG. 6A, the length ("x") is approximately 0.250 inches or less. The width ("y") is approximately 0.200 inches or less. As noted above, component 100 is a low profile device, and accordingly, the height (dimension z) in FIG. 6B is approximately 0.05 inches or less. Referring to FIG. 6C, dimension k is approximately 0.120 inches or less, dimension L is approximately 0.170 inches or less, the pin width ("m") is approximately 0.040 inches, and dimension "n" is approximately 0.020 inches or less. Again, this is merely one exemplary embodiment of the present invention and the size of component 100 may vary depending on the application.

Coupler 100 may be employed in a wide variety of RF and microwave applications such as balanced amplifiers, variable phase shifter, attenuators, LNAs, etc. The surface mount component 100 is ideally suited for use on relatively small printed circuit boards, such as those employed in wireless systems.

The ceramic pucks (FIGS. 1-4), or the use of a single ceramic sheet as a bottom layer, provides high thermal conductivity to the PCB base plate (heat sink) which, in turn, enables a high average power handling capabilities (approximately 250 W). Furthermore, if all of the conductors are disposed on softboard materials, the quality of the manufacturing processes and the large panel sizes (i.e., panels greater than 1 square foot(SF)) associated with softboard manufacturing are maintained. Further, because the conductors are implemented in softboard, the size and quality of the conductive lines are excellent. The present invention, therefore, may be employed to manufacture miniature high power stripline components while maintaining the high volume, low cost, large panel manufacturing practices associated with softboard processes.

Figure 7:
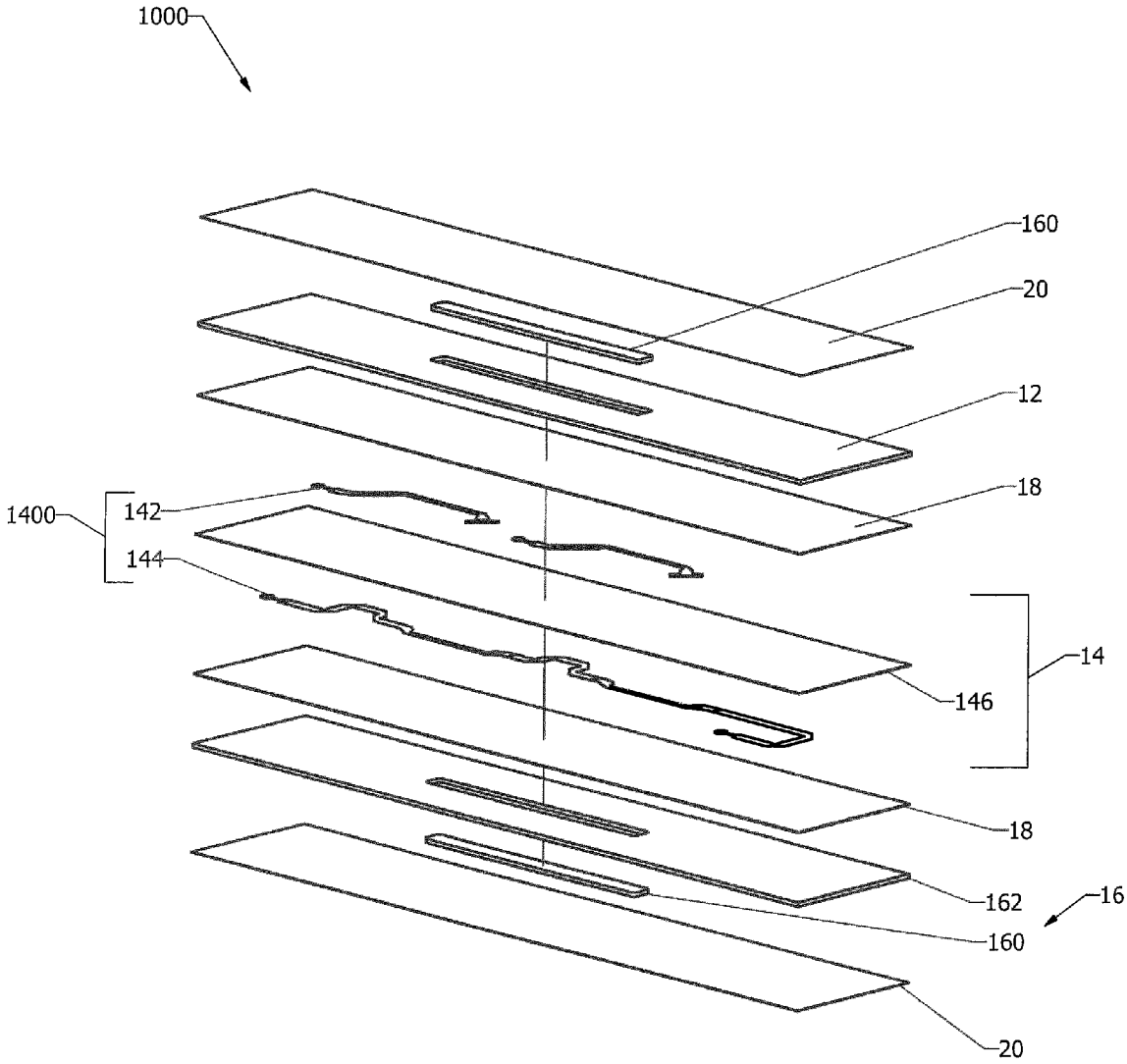
FIG. 7 is an exploded view of yet another alternate embodiment of the present invention.

FIG. 7 is an exploded view of yet another alternate embodiment 1000 of the present invention. In previous embodiments, single discrete devices 100 are disposed on a panel 10 and subsequently cut into separate surface mount component pieces in the manner depicted in FIGS. 6A-6C. In FIG. 7, "K" component devices are interconnected to form an integrated stripline assembly 1400, K being an integer. A relatively larger puck 160 is disposed under the portion of assembly 1400 that generates the most thermal energy. One of ordinary skill in the art will also understand that a single puck 160 may be replaced by a plurality of pucks of various shapes and sizes that are strategically disposed under/over components that generate the most heat. In accordance with FIG. 7, the pucks 160 may be disposed in both the top layer 12 and the bottom layer 16 as needed.

Figure 8:
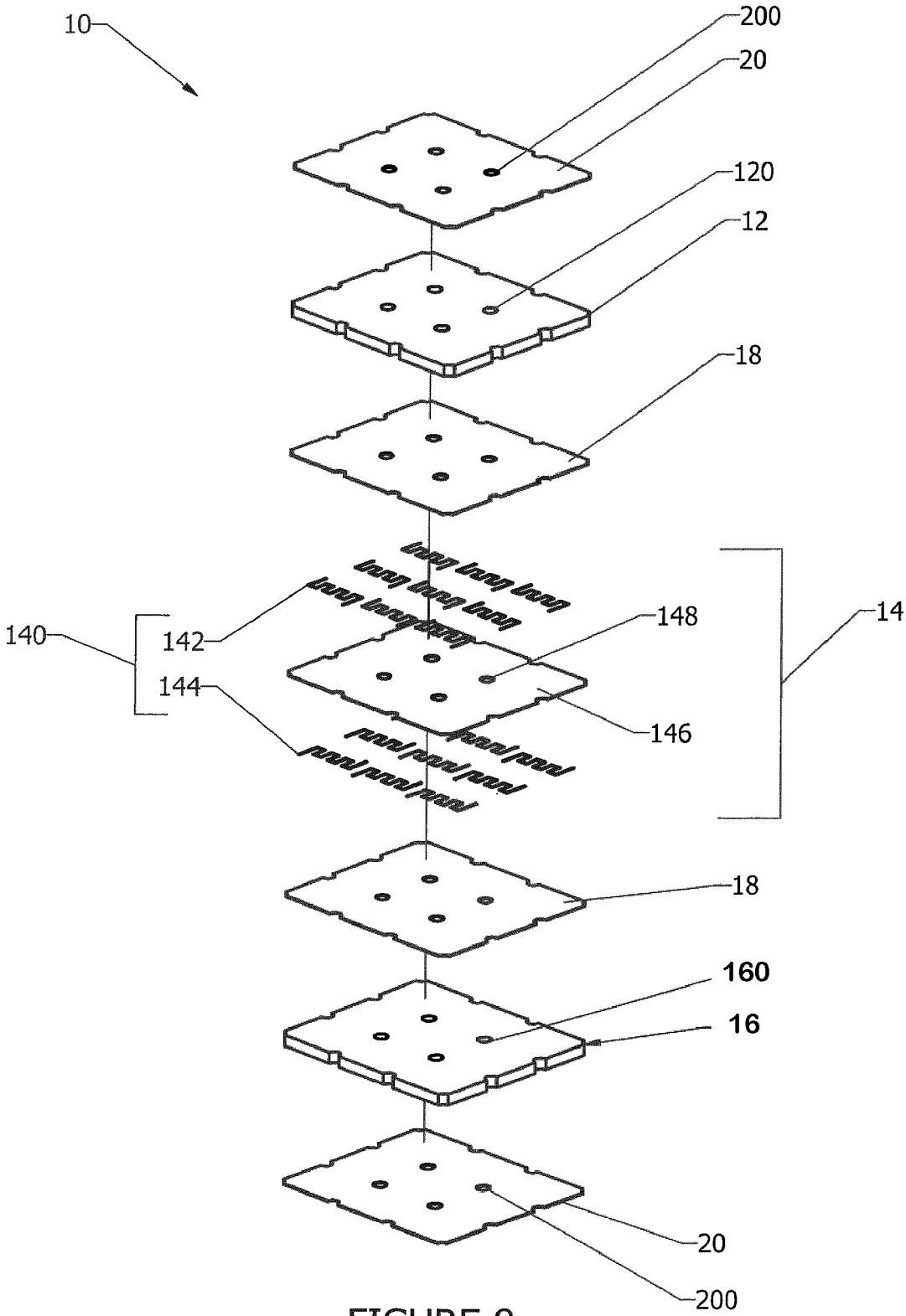
FIG. 8 is an exploded view of yet another alternate embodiment of the present invention.

As embodied herein and depicted in FIG. 8, an exploded view of yet another alternate embodiment of the present invention is disclosed. Like previous embodiments, the device panel structure 10 includes an upper dielectric layer 12 and a lower dielectric layer 16 disposed in substantially parallel planes one to the other. An inner device layer 14 is sandwiched between the upper layer 12 and the lower layer 16. Bonding film 18 is used bond the layers 12, 14, 16 together. Heat and pressure are applied to the assembled layers (12, 14, 16) to form an integrated laminated panel structure 10.

As before, the inner circuit layer 14 is formed from a relatively thin softboard dielectric material 146 that includes a top conductive layer and a bottom conductive layer disposed on either side of dielectric 146. Each stripline device 140 is formed using standard photolithographic techniques wherein stripline transmission line structures (142, 144) are imaged on the top and bottom layers of dielectric layer 146. The excess material is etched away to form an array of devices 140. This technique is used to dispose and align the transmission lines (142, 144) on the top and bottom surfaces with great accuracy. Layer 14 is shown to include an N×M array of stripline devices 140. While the example provided in FIG. 3 sets N and M as being equal to three (3), those of ordinary skill in the art will understand that N and M are typically very large integer values. The major surface area of the device panel structure 10 is typically greater than one (1) square foot. The stripline devices 140 themselves are typically much smaller, usually less then 1.0 square inch. The surface area footprint of a typical device is usually, half that, i.e., 0.05 inches. Of course, the surface footprint of the device may be any suitable size.

Top dielectric layer 12 is formed from one of the softboard dielectric materials disclosed herein. A conductive sheet 20 is disposed over the top surface of layer 12 and functions as a ground plane. In this embodiment, the bottom dielectric layer 16 is formed from a single sheet of ceramic material. A second conductive sheet 20 is disposed on the bottom surface of the ceramic dielectric material 16 and functions as a second ground plane.

Once again, conductive vias (200, 120, 148, 160) are formed in the various layers of the device to provide input/output ports for each of the stripline devices 140. The ports are subsequently connected to pads disposed on the exterior of the component package in the manner shown in FIGS. 6A-6C.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A method for making a hybrid material stripline device, the method comprising:

providing an inner layer of material, the inner layer including a dielectric material and at least one conductive sheet;

forming at least one stripline device in the inner layer by processing the at least one conductive sheet, the at least one stripline device being characterized by a surface area footprint;

providing a first exterior layer and a second exterior layer, the first exterior layer and/or the second exterior layer including at least one ceramic portion, the at least one ceramic portion having a ceramic surface area greater than or substantially equal to the surface area footprint of the at least one stripline device, the first exterior layer and/or the second exterior layer further comprising a softboard dielectric material, the at least one ceramic portion being separate and distinct from the softboard dielectric material;

sandwiching the inner layer of material between the first exterior layer and the second exterior layer;

laminating the first exterior layer, the inner layer and the second exterior layer to form a laminate panel structure, a surface of the first exterior layer forming a first major surface of the laminate panel structure and a surface of the second exterior layer forming a second major surface of the laminate panel structure; and disposing a first conductive sheet over the first major surface and a second conductive sheet over the second major surface, the first conductive sheet and the second conductive sheet being configured as parallel ground planes for the at least one stripline device.

2. The method of claim 1, wherein the at least one stripline device includes a plurality of stripline devices.

3. The method of claim 2, wherein the at least one ceramic portion includes a plurality of ceramic portions, each of the plurality of ceramic portions being aligned with a corresponding one of the plurality of stripline devices.

4. The method of claim 3, wherein the plurality of stripline devices and the corresponding plurality of ceramic portions are disposed in an N×M rectangular array of devices, N and M being integer values greater than or equal to two (2).

5. The method of claim 3, wherein the surface area footprint is less than 1.0 square inches.

6. The method of claim 3, wherein the first major surface and the second major surface have surface areas greater than or equal to one square foot.

7. The method of claim 2, wherein the at least one ceramic portion is configured to cover two or more of the plurality of stripline devices.

8. The method of claim 2, wherein the at least one ceramic portion includes a single ceramic sheet configured to cover all of the plurality of stripline devices, the single ceramic sheet comprising or substantially comprising the first exterior layer, the second exterior layer being substantially comprised of the softboard material.

9. The method of claim 2, further comprising the step of dividing the laminated panel structure into the plurality of stripline devices.

10. The method of claim 1, wherein the step of forming the at least one strip line device includes forming a transmission line structure.

11. The method of claim 1, wherein the at least one conductive sheet includes parallel conductive sheets disposed on either side of the dielectric material of the inner layer, and the step of forming includes processing each of the parallel conductive sheets.

12. The method of claim 11, wherein the step of forming the at least one strip line device includes selecting the at least one stripline device from a group of stripline devices that includes a directional coupler, a balun, a power divider, and/or a power combiner.

13. The method of claim 1, wherein the at least one ceramic portion is comprised of a material selected from a group of materials that includes alumina, AlN ceramic, BeO, or LTCC.

14. The method of claim 1, wherein the step of providing the first exterior layer and the second exterior layer includes forming interconnection vias in either or both of the first exterior layer and the second exterior layer, the interconnection vias being coupled to the at least one stripline device.

15. A stripline structure comprising:

a first exterior layer and a second exterior layer disposed in substantially parallel planes one to the other, the first exterior layer and/or the second exterior layer including at least one ceramic portion having a ceramic surface area, the first exterior layer and/or the second exterior layer comprising a softboard dielectric material, the at least one ceramic portion being separate and distinct from the softboard dielectric material;

an inner layer sandwiched between the first exterior layer and the second exterior layer, the inner layer having at least one stripline device therein, the at least one stripline device being characterized by a surface area footprint, the ceramic surface area being greater than or substantially equal to the surface area footprint, the first exterior layer, the inner layer, and the second exterior layer being laminated to thereby form a laminated panel structure, the laminated panel structure having a first exterior major surface and a second exterior major surface;

a first conductive sheet disposed over the first exterior major surface and a second conductive sheet disposed over the second exterior major surface, the first conductive sheet and the second conductive sheet being configured as parallel ground planes for the at least one stripline device; and a plurality of conductive vias formed in the first exterior layer and/or the second exterior layer, the plurality of conductive vias being in electrical communication with the at least one stripline device.

16. The structure of claim 15, wherein the at least one stripline device includes a plurality of stripline devices.

17. The structure of claim 16, wherein the at least one ceramic portion includes a plurality of ceramic portions, each of the plurality of ceramic portions being aligned with a corresponding one of the plurality of stripline devices.

18. The structure of claim 17, wherein the plurality of stripline devices and the corresponding plurality of ceramic portions are disposed in an N×M rectangular away of devices, N and M being integer values greater than or equal to two (2).

19. The structure of claim 17, wherein the surface area footprint is less than 1.0 square inches.

20. The structure of claim 17, wherein the first major surface and the second major surface have surface areas greater than or equal to one square foot.

21. The structure of claim 16, wherein the at least one ceramic portion is configured to cover two or more of the plurality of stripline devices.

22. The structure of claim 16, wherein the at least one ceramic portion includes a single ceramic sheet configured to cover all of the plurality of stripline devices, the single ceramic sheet comprising or substantially comprising the first exterior layer, the second exterior layer being substantially comprised of the softboard material.

23. The structure of claim 16, wherein the laminated panel structure is configured to be divided into the plurality of stripline devices.

24. The structure of claim 15, wherein the at least one strip line device includes a transmission line structure.

25. The structure of claim 15, wherein the at least one stripline device is selected from a group of stripline devices that includes a directional coupler, a balun, a power divider, and/or a power combiner.

* * * * *